US006302945B1

(12) United States Patent
Altman et al.

(10) Patent No.: US 6,302,945 B1
(45) Date of Patent: Oct. 16, 2001

(54) ELECTROSTATIC PRECIPITATOR FOR REMOVING $SO_2$

(75) Inventors: Ralph F. Altman, Chatanooga, TN (US); Richard G. Rhudy, Atherton, CA (US)

(73) Assignee: Electric Power Research Institute, Incorporated, Palo Alto, CA (US)

( * ) Notice: Subject to any disclaimer, the term of this patent is extended or adjusted under 35 U.S.C. 154(b) by 0 days.

(21) Appl. No.: 09/330,702

(22) Filed: Jun. 11, 1999

(51) Int. Cl.[7] ..... B03C 3/78
(52) U.S. Cl. ..... 96/44; 96/50; 96/52
(58) Field of Search ..... 96/52, 53, 27, 96/44, 46, 47, 50, 74; 95/64, 65, 71, 72

(56) References Cited

U.S. PATENT DOCUMENTS

| | | | | |
|---|---|---|---|---|
| 4,885,139 | | 12/1989 | Sparks et al. | 422/169 |
| 4,888,158 | * | 12/1989 | Downs | 96/53 X |
| 5,137,546 | * | 8/1992 | Steinbacher et al. | 96/52 X |
| 5,424,044 | * | 6/1995 | Kalka | 96/52 X |
| 5,486,342 | | 1/1996 | Moser et al. | 423/243.01 |
| 5,599,508 | | 2/1997 | Martinelli et al. | 422/169 |
| 5,601,791 | | 2/1997 | Plaks et al. | 95/59 X |
| 5,624,476 | * | 4/1997 | Eyraud | 95/71 X |
| 5,792,238 | | 8/1998 | Johnson et al. | 96/74 X |
| 6,117,403 | * | 9/2000 | Alix et al. | 96/65 X |

FOREIGN PATENT DOCUMENTS

| | | | | |
|---|---|---|---|---|
| 988350 | * | 4/1965 | (GB) | 96/53 |

* cited by examiner

*Primary Examiner*—Richard L. Chiesa
(74) *Attorney, Agent, or Firm*—Leonard Bloom

(57) ABSTRACT

An electrostatic precipitator for removing sulfur dioxide and other polluting particles has a wet liquid removal area or compartment down stream and in the last section of plates of the electrostatic precipitator.

1 Claim, 7 Drawing Sheets

ELECTROSTATIC PRECIPITATOR FOR REMOVING $SO_2$

FIELD OF THE INVENTION

The invention herein disclosed is involved with separating pollutants from the air by electrostatic precipitation.

BACKGROUND OF THE INVENTION

New concerns about the health affects of fine particles raise the possibility of a continuation of the trend towards more stringent emissions limits for the utility industry. The current belief is that ambient fine particles consist of both primary and secondary particles and that, in many regions of the country, $SO_2$ emissions from point sources make a significant contribution to the formation of the secondary particulate matter. These concerns, together with the pressure to cut costs to survive in a competitive environment, point to the need for new, inexpensive technologies to control particulate and $SO_2$ emissions from power plants.

Electric power generating plants, industrial boilers and other industrial processes generate particulates, acid gases and toxic materials that are harmful to the environment. Particulate matter can remain suspended in the air for an extended period and when breathed can present a potential health hazard. The particulates also tend to settle on surfaces such as buildings, machinery or curtains, where they can cause unsightly discoloration and interfere with proper function of equipment. In addition, trace metals are harmful to humans and other animal species. Thus, it is important to remove particulates from an exhaust gas stream. Moreover, acid gases, such as $SO_2$ and $SO_3$ have been found to contribute to damaging acid rain. Technologies for control of acid gases such as spray dryers and scrubbers are well known in the art. However, such control systems are expensive and their installation requires significant amounts of space.

There are a number of commercial technologies that can separately control power plant particulate and $SO_2$ emissions. Both ESP (Electrostatic Precipitator) and fabric filters are used for particulate control, and either wet or dry scrubbers are used for $SO_2$ control. The costs for both controls are moderate in terms of overall power generating costs, but both technologies require equipment that is substantial in size, and both technologies require considerable maintenance.

Prior Art Patents

Sparks et al in U.S. Pat. No. 4,885,139 teach an electrostatic precipitator for removing sulfur oxides and particulate matter by treating sulfur oxide or other acidic gases in a multi-stage electrostatic precipitator within a single housing. The sulfur oxides and acidic gas removal system works by spraying a neutralizing slurry or solution into incoming flue gas to form neutral salts which dry in a reaction zone. As pointed out in the patent to Sparks et al, the first stage of the electrostatic precipitator involves absorption of the $SO_x$ by the injected alkali drops; the second phase consists of $SO_x$ transfer to the wet alkali particles which exit after the drops are evaporated and the final phase consists of reaction of $SO_x$ with the dry particles. Note particularly that the flue gas is sprayed upstream from the collection plates.

Plaks et al in U.S. Pat. No. 5,601,791 teach an electrostatic precipitator for removal of acid gases by spraying an acid gas neutralizing agent through nozzles at a point upstream of the electrostatic collectors. In an alternative embodiment, the neutralizing agent is introduced into the transition zone which is upstream of the plates; and in a still further embodiment the neutralizing agent is injected at a point upstream of one set of plates and downstream of a second set of plates, that is, between two sets of plates in the stream. A careful review of the prior art patents indicates that none teaches an electrostatic precipitator where in the acid neutralization step takes place down stream of all the collection plates.

In addition, regarding the Sparks and Plaks patents, there are significant differences between the technology in these patents and the concept of the instant invention. In both of the patents, a slurry is sprayed into a precipitator, either in the transition piece just ahead of the precipitator (ESP) or in the front of the ESP in the volume that was occupied by the front or first field (first set of collection plates) of the ESP. In either case, the slurry must evaporate to dryness before it is collected in the ESP because the ESP is operated in a dry mode. The ESP must collect this particulate matter; and further, the ESP mixes the $SO_2$ sorbent reaction products with the fly ash which may create a waste product that is difficult to dispose of. In a small ESP, the increased dust loading (and/or loss of the front field) may make it very difficult to maintain compliance with particulate emission limits. In addition, the spray system must produce very fine droplets if these droplets are to evaporate in the one or two second residence time between the spray nozzles and the first active field of the ESP.

In contrast, the new concept of this invention leaves the front part of the ESP alone and modifies the last one or two fields. Because of the exponential nature of the collection process, most of the fly ash is collected before reaching the part of the ESP that has been modified. Typically, 90% or more of the fly ash is collected in the unmodified ESP fields, and this uncontaminated ash can be gold as a concrete or cement additive. The last one or two fields are modified to operate in a wet mode, continuously eliminating the need to dry the sorbent before it is collected. This new approach actually improves the collection of particulate matter because it eliminates power limitations that can be imposed by the high electrical resistivity of dry fly ash and furthermore wet plate cleaning also eliminates reentrainment. In fact, EPRI-sponsored tests have demonstrated that converting the last field of a conventional dry ESP to wet operation could reduce outlet particulate emissions by a factor of five or more. Since in the new concept a clear liquid is sprayed into the ESP, there is no increase in the particulate matter the ESP must collect. Furthermore, the new process produces a waste product that is relatively easy to dispose of.

Objects of the Invention

It is an object of the invention to provide an apparatus and process for removing acidic gas and particulate matter from the gas stream of an ESP and to more efficiently collect and dispose of gaseous and particulate pollutants.

A further object of the invention is to provide an ESP that can remove acid gases, as well as toxic gases, without major modification of existing ESP equipment.

A still further object of the invention is to provide an ESP of high efficiency and durability.

A yet further object of this invention is to fashion an ESP improvement that is easy to retrofit into existing equipment.

An important object of this invention is to develop a device having improved efficiency for ESPs (Electrostatic precipitators) along with more reliable scrubber operation.

A significant object of this invention is to employ a clear liquor scrubbing solution which will minimize plugging and scaling of the equipment.

Another significant feature of this invention is the ability of the ESP to efficiently remove particulate matter.

SUMMARY OF THE INVENTION

The herein disclosed invention converts the last field of an existing ESP to wet operation. To effect the conversion, the last field or fields of an existing dry ESP is removed and replaced with components made from materials suitable for operation in a wet environment. After the ESP is converted, an alkali solution is sprayed on the collection plates to flush the collected particulate matter away and absorb acid gases. Preliminary tests indicate that this conversion can reduce particulate emissions for a small ESP by a factor of five or more.

The herein disclosed invention has the potential of greatly reducing the cost of $SO_2$ control and, at the same time, reducing power plant particulate emissions. The new concept illustrated in FIGS. 3 and 5–6, depict views of an electrostatic precipitator. Electrostatic precipitators normally have three or more electric fields in the direction of gas flow. In the new concept described herein, one or more of the last fields of the ESP are physically removed. The old internals are replaced with a similar, but smaller, set of parallel collection plates. Discharge electrodes with an aggressive design capable of operating in a high space charge environment are placed between the plates. This modification makes room for spray nozzles. The nozzles, with either a single fluid or dual fluid design, would be added to allow for the introduction of a clear liquor (a reagent solution containing very little undissolved solids, rather than the slurries used in conventional lime/limestone scrubbers) into the volume surrounding the plates. As the flue gas passes through the sprays of clear liquor scrubbing solution, the $SO_2$ is absorbed by the alkali water droplets. Further, with a sufficient volume of liquor directed toward the collection plates, a moving liquid film is created on the plates that continuously sweeps away the particulate matter deposited on the plates by the electrostatic forces in the ESP. The nozzles and plates are arranged so that the quantity of liquid drops that exit from the last set of collection plates is minimized. Stated another way, the solid particulate matter from the exhaust gas is electrostatically attracted to the collection plates, while the $SO_2$ gas is neutralized by the clear liquor scrubbing solution.

The invention also encompasses the use of a clear liquid scrubbing system, rather than a slurry. This is an advanced FGD (flue gas desulfurization) process that removes more than 99% of the sulfur dioxide from the flue gas. This process avoids the scaling and plugging problems inherent in slurry scrubbing chemistry. In addition, the process uses an inexpensive and readily available reagent (limestone-calcium carbonate) and produces a usable byproduct (anhydrite—$CaSO_4$). The basic CLS (clear liquid scrubbing) concept recirculates clear liquor that contains a sufficient liquid-phase alkalinity (using an organic acid additive) to achieve the desired $SO_2$ removal efficiency without the need for solid-phase alkalinity. The liquor then flows to a limestone reactor and solid-liquid separator that precipitates a calcium-sulfur solid and returns clear liquor to the scrubber. The CLS process can be operated as an inhibited-oxidation system (calcium sulfite production) or as a forced-oxidation system (gypsum hydrated calcium sulfate production). Either of these two products can then be converted to anhydrite (calcium sulfate); however, the economics of the anhydrite process are more favorable if calcium sulfite is produced in the CLS system. Examples of a clear liquid scrubbing process are to be found in U.S. Pat. No. 5,486,342. For most efficient operation of ESP equipment, it is important that a clear solution, rather than a slurry, be employed.

The main advantage to using the clear liquor scrubbing solution is the fact that this solution eliminates precipitates formed between the sulfur oxide gases and alkali thereby preventing the potential for plugging, scaling or solids build up on the electrostatic precipitator.

The concept of this invention makes use of equipment that already exists at most power plants in the novel way described to significantly reduce both particulate and SOx emissions. It is the utilization of an existing piece of equipment, including the foundations, structural steel and casing, that is responsible for the significant reduction in cost that results from application of this process. Only replacement of the internals of one or more fields and the addition of the external liquor processing equipment are needed to effect the conversion. No known commercial technology has as great a potential for both cost reduction and pollutant control.

The primary application of the herein disclosed invention will be employed at utility plants with existing ESPs. The technology is to be used both here and abroad. In addition, the technology might be applicable to other industrial processes that use ESPs for particulate control. Such processes might include cement manufacturing and certain metallurgical processes. Finally, the technology could be applied to new generating plants where it would be cheaper than building separate pieces of equipment for particulate and $SO_2$ control.

These and other objects of the present invention will become apparent from a reading of the following specification taken in conjunction with the enclosed drawings.

DESCRIPTION

Figure 1:
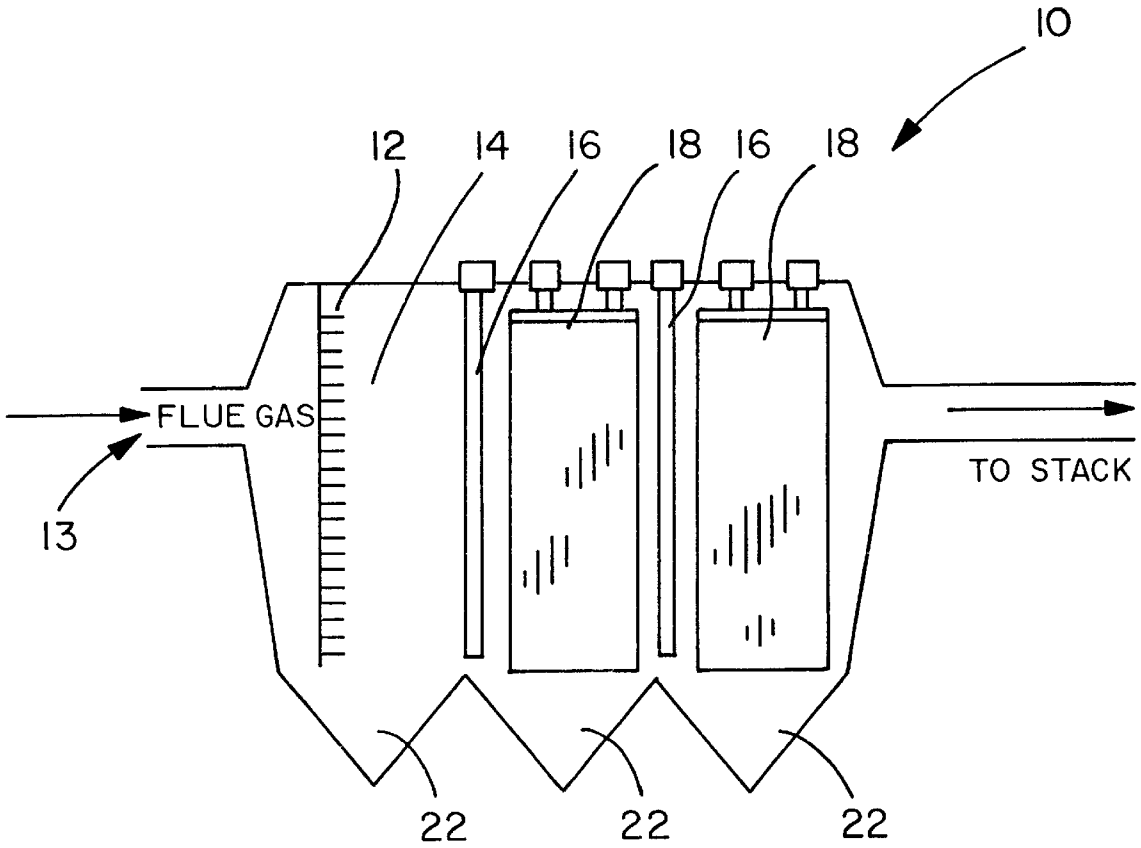
FIG. 1 PRIOR ART
FIG. 1 is a schematic representation of a prior art electrostatic precipitator with the neutralizing solution being sprayed upstream of the plates.

With reference to FIG. 1, there is shown a prior art electrostatic precipitator 10 with the $SO_x$ eutralizer 12 being sprayed at a location 14 upstream of the plates; this embodiment is shown by Sparks et al (4,885,139). In the embodiment shown by Sparks et al, flue gas containing particulates and $SO_x$ enter apparatus 10 and flows past nozzles or atomizers 12. The nozzles 12 spray the flue oas 13 with an aqueous solution of an alkaline neutralizing agent, preferably sodium bicarbonate or calcium carbonate. The sprayed flue gas then flows into reaction zone 14 between nozzles 12 and a particle charger 16. In reaction zone 14, $SO_x$ first dissolves in the aqueous neutralizing solution and then reacts with the neutralizing agents therein to produce dissolved neutral salts. As evaporation of water and cooling of the flue gas occurs, the dissolved salts precipitates as neutral, wet salts. The temperature of the flue gas entering the housing reaction assists in the evaporation of water so that, by the time the flue gas has reached the end of reaction zone 14 and the charger 16, the flue gas and particles therein are essentially dry. The charger 16 is connected to a high voltage D.C. power supply and preferably connected to the negative terminal of the power supply. The particles receive a negative charge as they pass the charger 16 and are removed from the gas stream by an electrostatic precipitator (ESP) on to plates 18. Once on the plates 18, the particles may be removed therefrom by any conventional means, such as a mechanical hammer or scraper (not shown) to fall into a hopper 22. In order to make up for the loss of the collection that would have otherwise occurred in the removed field, additional charging elements 16 are added to try to increase the collection in the remaining field. Such an addition is not needed in the new technology described in this application.

Figure 2:
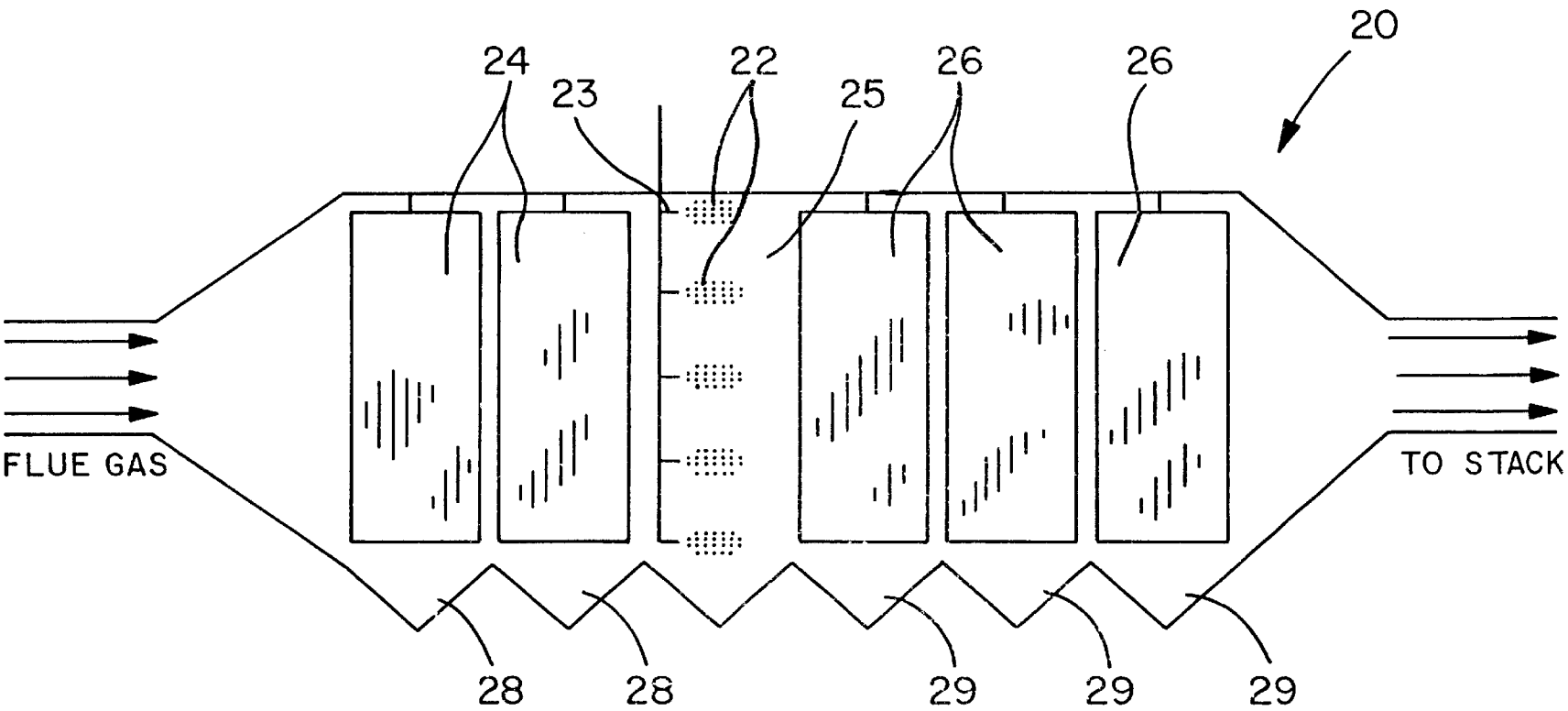
FIG. 2 PRIOR ART
FIG. 2 is a schematic representation of a prior art electrostatic precipitator with the solution being sprayed between sets of plates.

With reference to FIG. 2 there is shown an alternative embodiment of a prior art electrostatic precipitator 20 wherein the neutralizing agent 22 is sprayed in reaction zone 25, located between two sets of dry plates 24 and 26, respectively. The embodiment FIG. 2 is shown by Plaks et al (5,601,791). In the Plaks et al embodiment of the invention shown in FIG. 2, neutralizing agent 22 is injected through nozzles 23 into a reaction zone 25 located upstream of the grounded collector plates 26 but downstream of upstream grounded collector plates 24. The upstream grounded collector plates 24 are part of one or more upstream collector sections. A large fraction of the particulates entering the ESP are collected on the upstream grounded collector plates 24. The collected particulates are removed from the upstream collector plates 24 by conventional means such as rapping. The collected particulates fall into upstream hoppers 28 from which they are removed. Downstream collector plates 26 collect spent neutralizing agent and particulates not collected by the upstream collector. Material collected on the downstream grounded collector 24 is collected in hoppers 29.

Note particularly that in neither of these prior art embodiments, is the location of the neutralizing spray downstream of the last set of plates.

The invention shown in FIGS. 3 and 5–7 describe a novel way of combining features of a conventional, dry electrostatic precipitator with a new, wet scrubbing technology to produce a single device that is capable of collecting both the suspended particulate matter (fly ash) and gaseous acid contaminants ($SO_2$, $SO_3$, HCl and HF) in a single device.

Figure 3:
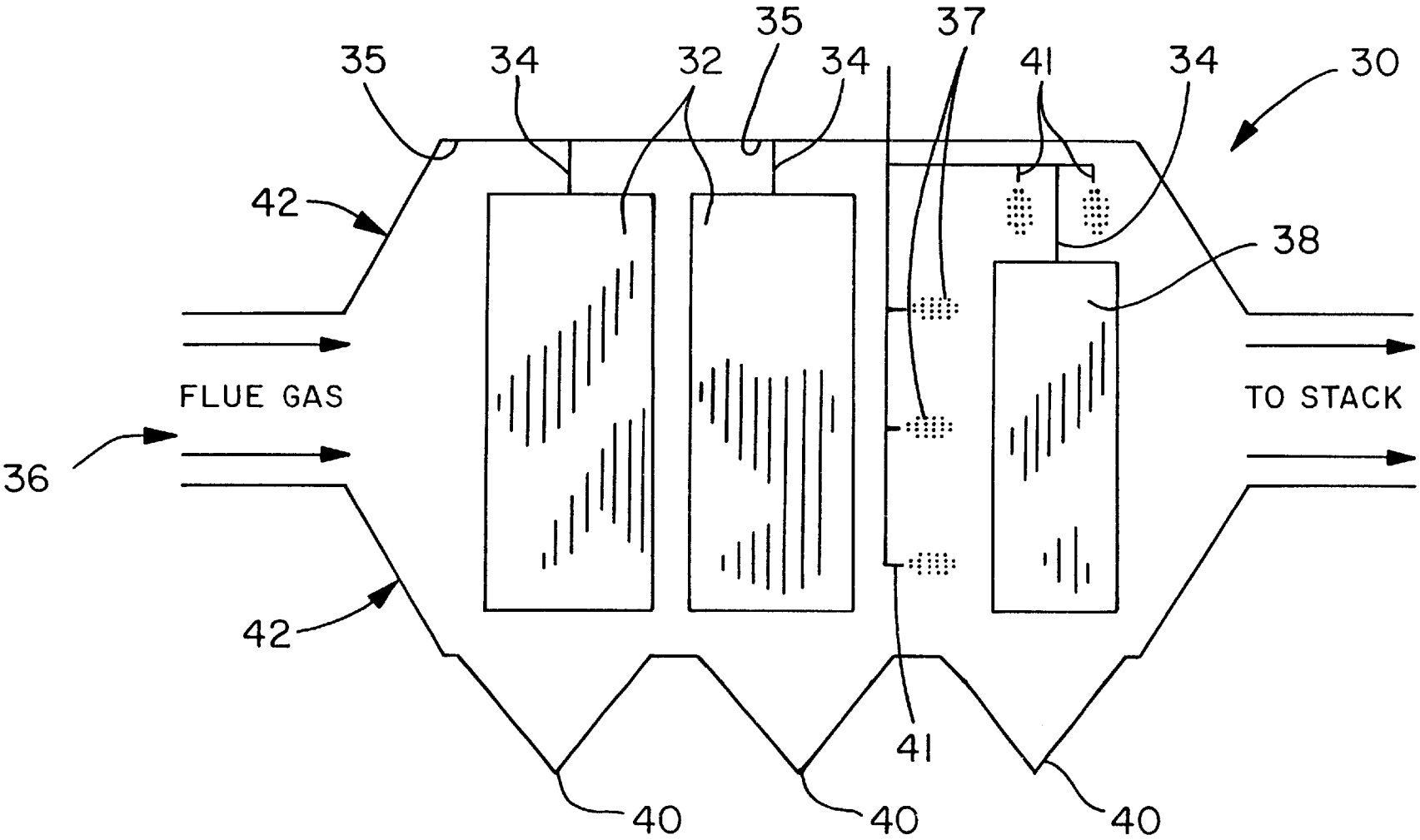
FIG. 3 is a schematic representation of the electrostatic precipitator of this invention with the neutralizing solution sprayed on the last plate.

With reference to FIG. 3 an electrostatic precipitator of this invention has plates 32 suspended by wires 34 from the inside 35 housing of the electrostatic precipitator 30. Neutralizing solution 37 is sprayed out of nozzle 41 on the last set of plates 38. In FIG. 3 as shown, flue gas enters the housing 42 of the electrostatic precipitator 30 through an intake port 36 or front end and the flue gas containing $SO_x$ gases and other pollutants is given an electric charge by suspended electrodes (not shown) and caused to be attracted to and adhere to plates 32. Hoppers 40 are provided at the bottom of the housing 42 of the electrostatic precipitator to receive particles of pollutants and spent spray solution. In the figures the hoppers (40) are shown as pyramid shaped, however, this shape is not critical, for example, the pyramid below the wet plate section could be truncated.

Figure 4:
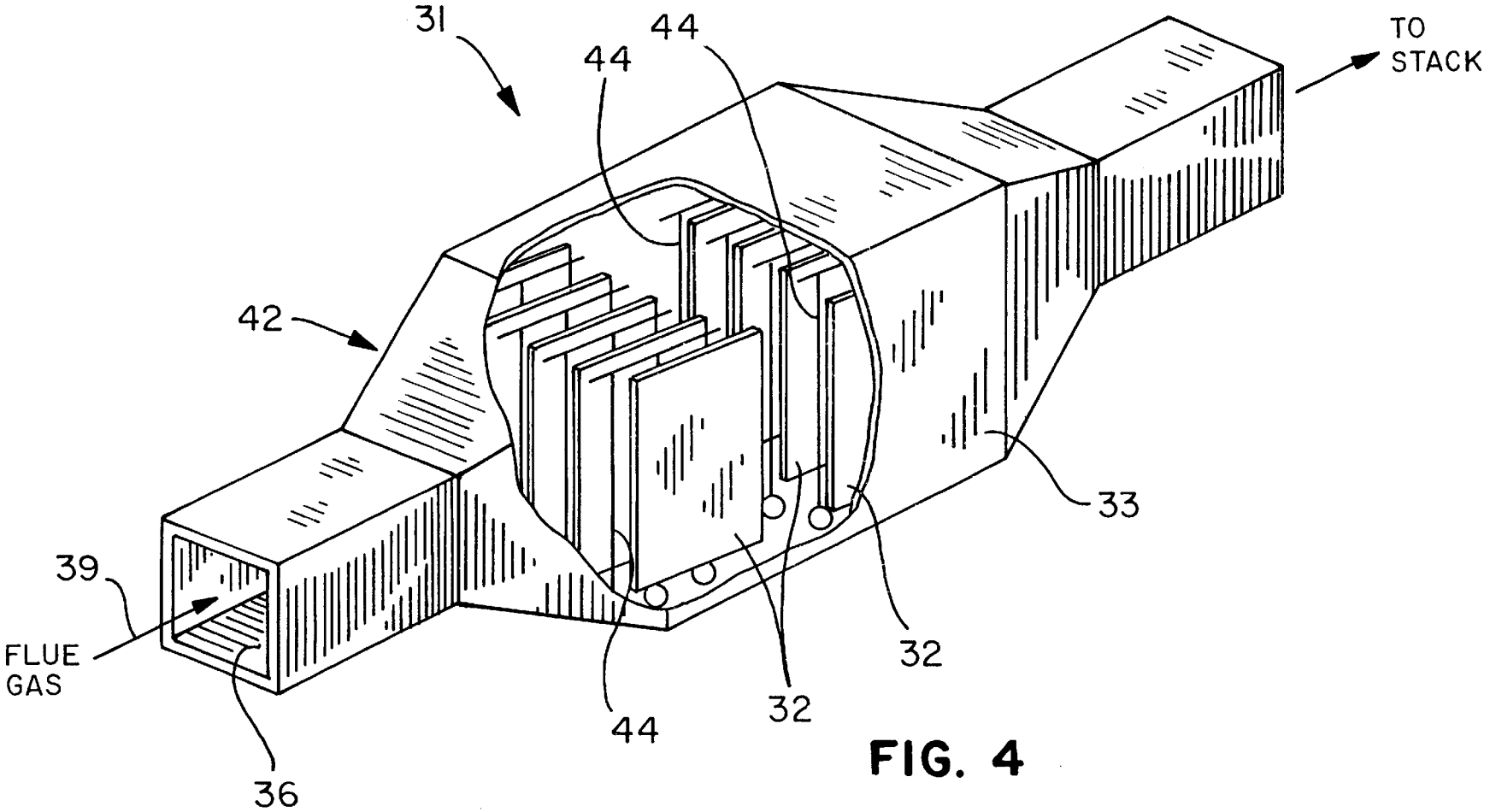
FIG. 4 is a perspective view of an electrostatic precipitator showing the relationship of the plates and electrodes.

FIG. 4 shows a perspective view of an unmodified typical electrostatic precipitator (ESP) and does not have a section of plates to be washed. Parts of some of the outside wall 33 has been cut away so that the relationship of the internal plates 32 of the ESP 31 can be conceptualized. The internal portion consists of several collections of tall plates 32 and are further identified as collection plates. The plates 32 are arranged in rows across the direction of gas flow 39. Each row of plates 32 (or field) consists of many parallel plates spaced apart by 9 to 16 inches. Dirty flue gas enters the precipitator 30 at one end 36 and flows through the spaces or gas passages between the parallel plates 32. The plates, which are usually 30 to 45 feet tall and 9 to 12 feet in the direction of gas flow, are usually hung from the top. A number of small-diameter wires 44 are hung from the top of the precipitator from a support system that is electrically insulated from the rest of the ESP 31.

These wires 44 are centered in the space between the plates as illustrated in the drawing of FIG. 4. A very high voltage is applied to the wires which causes them to initiate a corona discharge. This discharge produces a stream of charged ions which, in turn, charges the particulate matter in the gas stream. At the same time, the high voltage applied to the wires creates a strong electric field between the plates and wires. This electric field moves the particles onto the "collection" plates 32 after the particles have become sufficiently charged.

In a conventional ESP, periodically the particulate matter that has been collected on the plates 32 is removed by striking the plates with a mechanical device called a rapper (not shown). The rapper strikes with such a force that the particulate matter charged on the plate is dislodged and falls into a pyramid shaped hopper 40 below the row of plates (best shown in FIGS. 3 and 5). Unfortunately, some of the collected fly ash is reentrained into the flowing flue gas each time the plates are struck, and this reentrainment contributes to the inefficiency of the conventional collection process.

In a typical prior art ESP (FIG. 4) there are several rows of collection plates in the direction of gas flow. The rows of plates 32 are called fields. The gas flows out of one field into another in succession. Two such fields are illustrated in the attached drawing FIG. 4, but typically there are 3 to 8 such fields. Multiple fields are necessary because only 50 to 70% of the particulate matter that enters a field is collected before the gas flows out of the field. Put another way, 40% of particulate matter escapes from the first field uncollected. Of this remaining particulate matter, 40% escapes from the second field. This remaining amount is 16% of the original concentration entering the ESP. The collection process continues through each subsequent collection field. Forty percent of the particulate matter entering the third field escapes, but now the escaping fraction is only 6.4% of the concentration that entered the precipitator.

In the ESP of this invention, the number of sets of plates in an operational series could be four with three sets of dry plates and one last set of wet plates or wet collector plates. While the exact maximum number of sets of plates is not critical, the invention visualizes ESP's of eight sets of plates, namely, six sets of dry plates and two sets of wet plates or, for example, five sets of plates consisting of three sets of dry plates and 2 sets of wet plates. Each set of plates can have as many as a 100 plates. As noted in the figures, the plates are positioned so as to be in the direction of the gas flow. The neutralizing fluid can be applied to the plates from the top, as well as onto the plates from their leading edge. The liquid is sprayed in the direction of gas flow.

Regarding the current and voltages: The wet collector plates have higher voltages and current than the dry plates.

Typically, for the wet plate the voltage is about 35 kilovolt for a 9 inch gas passage and about 65 kilovolt for a 16 inch gas passage. The current in a typical wet plate installation will be at least about fifty microamp per square foot of plate surface area or higher as can be determined by those skilled in the art. Dry plates will have a lower current.

Referring to FIG. 3, in a concept that is the subject of the current invention, the last field of collection of plates, which are normally made of mild steel, has been removed and replaced with a series of slightly smaller stainless steel plates 38. Note that plates 38 are smaller than plates 32. Stainless steel discharge electrodes are again suspended between the plates (best shown in FIGS. 4 and 6) and a high voltage is applied to these discharge electrodes. The plates are made smaller to allow room for rows of headers and nozzles 41 that are used to spray liquid onto the plates. The spray liquid can be a clear alkaline solution.

Figure 5:
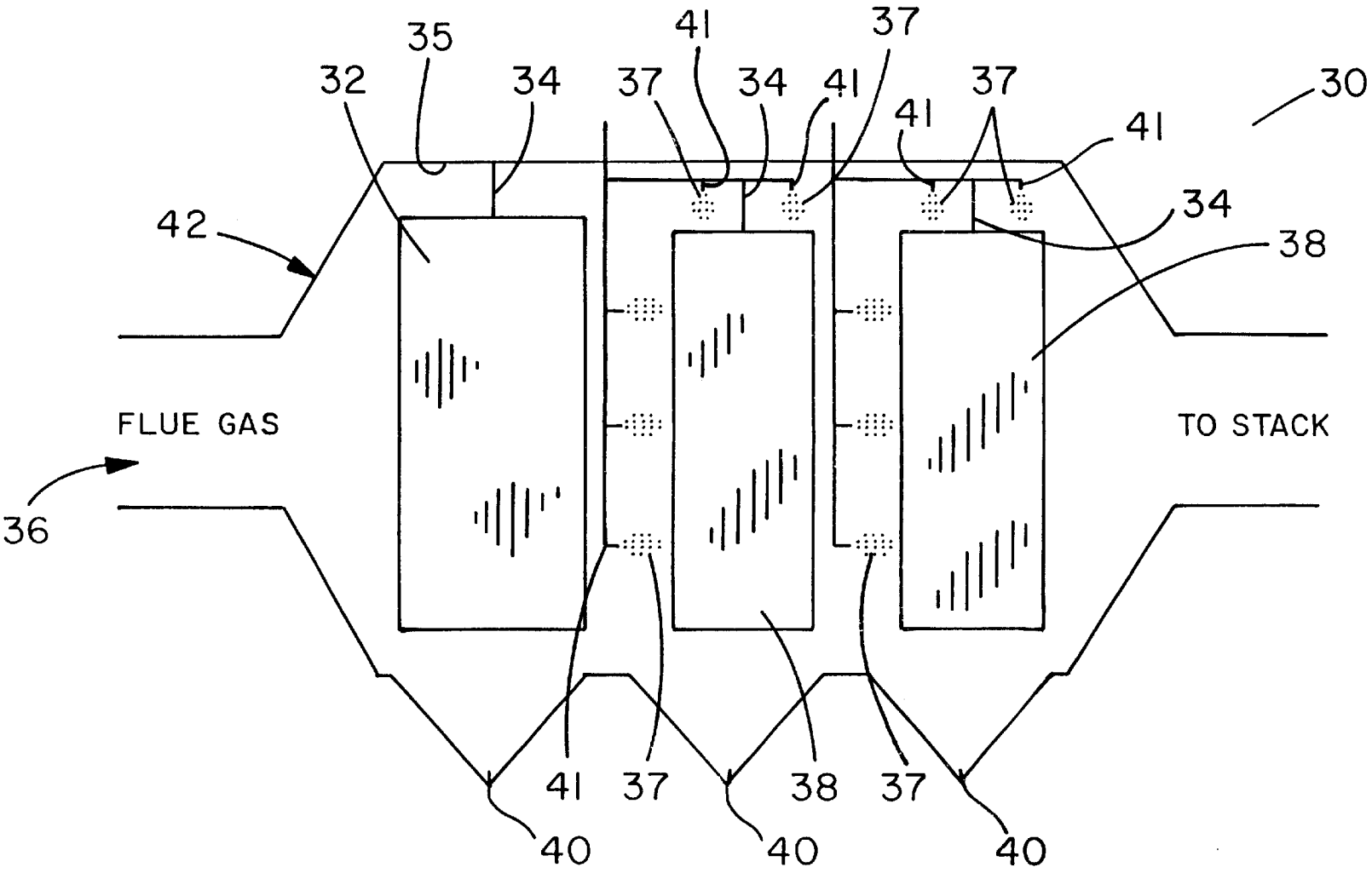
FIG. 5 is a schematic representation of an alternative embodiment of an electrostatic precipitator of this invention wherein the last two sets of plates are sprayed with neutralizing solution.

As shown in FIG. 5, a conventional electrostatic precipitator 30 has been retrofitted with two sets of wet plates 38. In this way, pollutant gas particles escaping from the first set of wet plates can be captured on the second set of wet plates downstream from the first set of plates.

Figure 6:
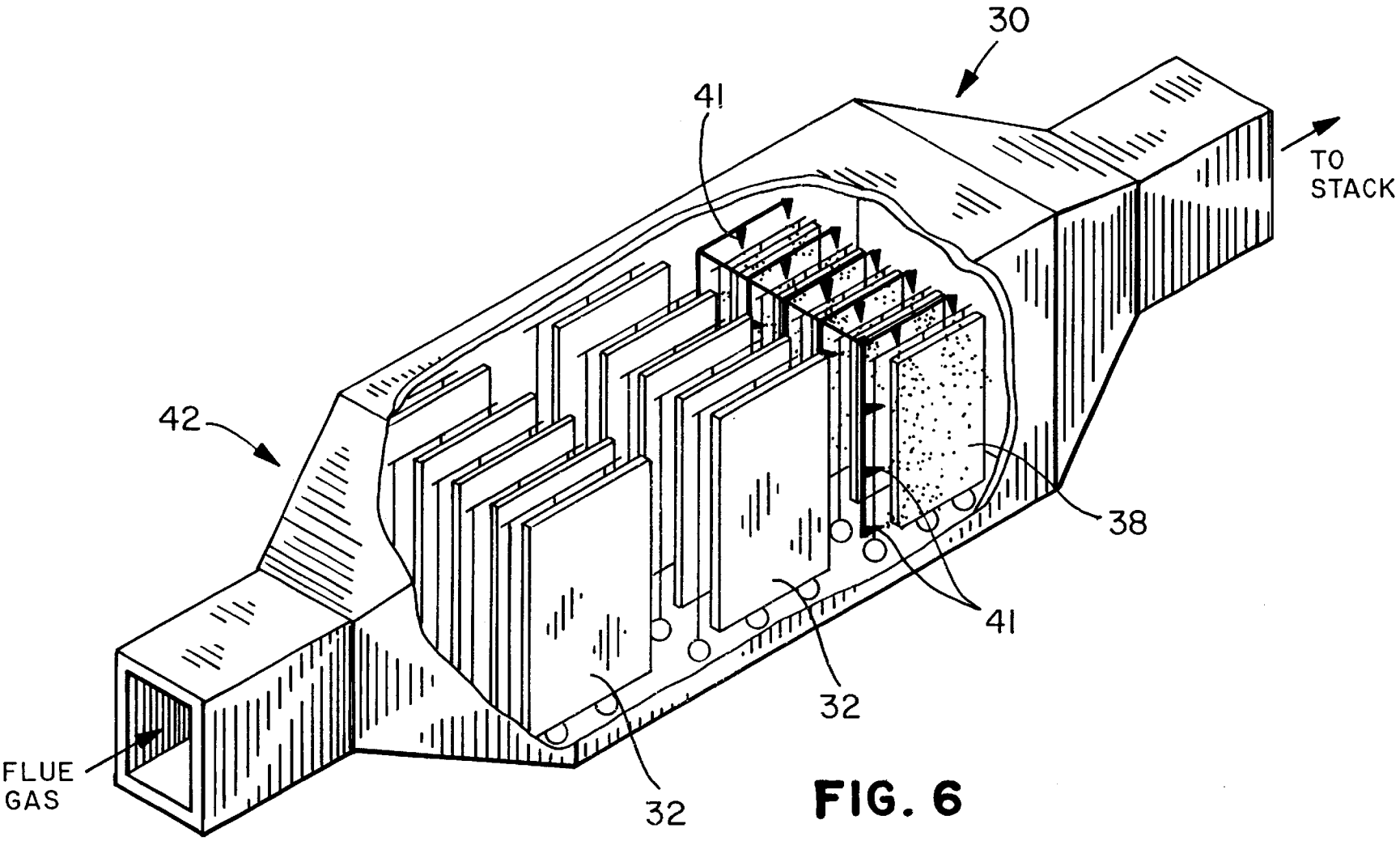
FIG. 6 is a perspective view of the electrostatic precipitator of this invention with only the last set of plates being sprayed.

With reference to FIG. 6, an electrostatic precipitator 30 of this invention is shown wherein a conventional electrostatic precipitator has been retrofitted with a single set of wet plates 38. These plates are sprayed with neutralizing solution 37 through spray nozzles 41 suspended from the top of the wet plates 38 and along their leading edge.

Figure 7:
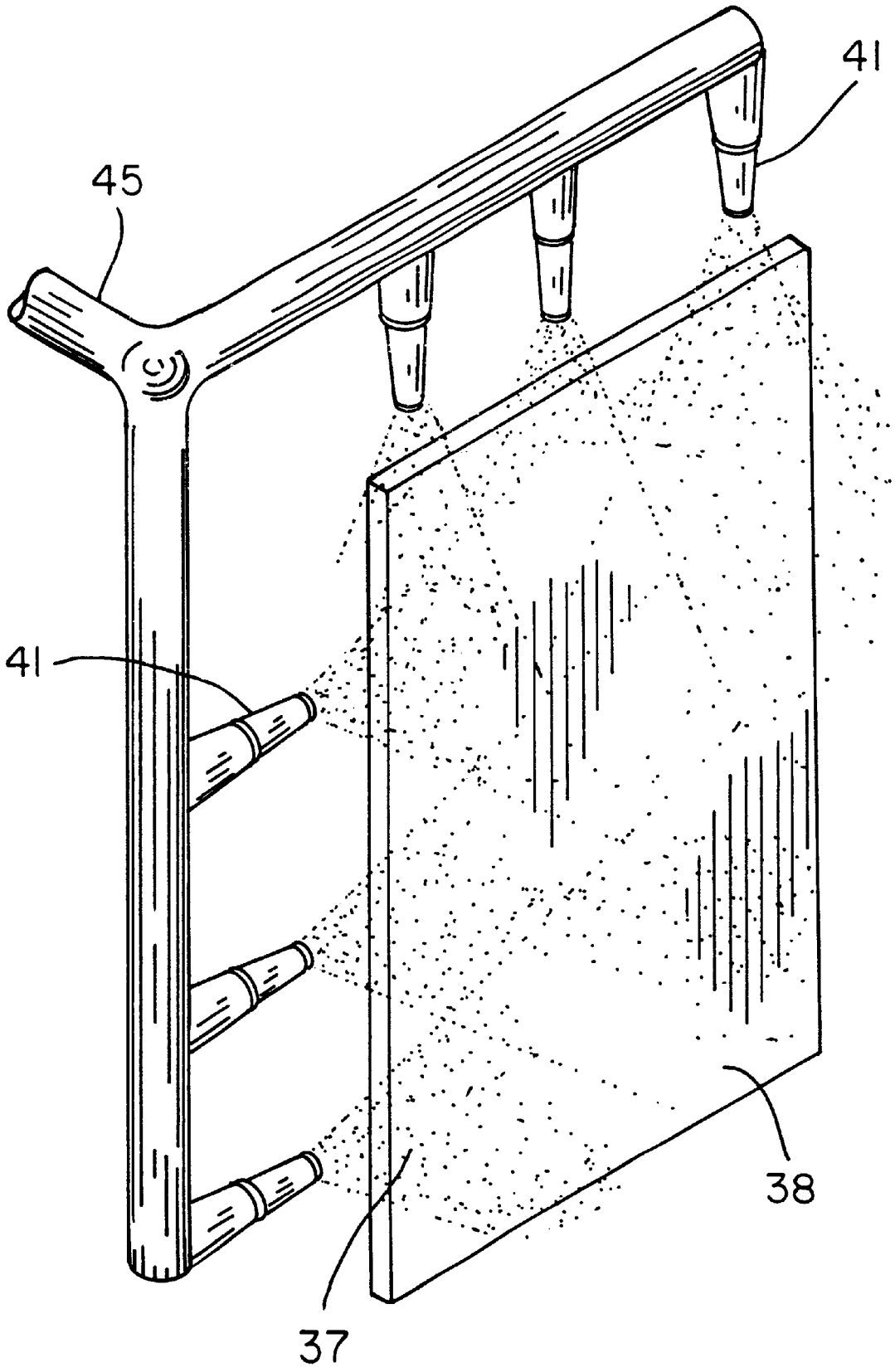
FIG. 7 is an enlarged perspective view of a single plate from the last set of plates of the electrostatic precipitator being sprayed.

FIG. 7 is an enlarged single view of a plate 38 shown isolated from the electrostatic precipitator. The plate is shown being sprayed with neutralizing solution delivered by nozzles attached to a piping system 45 designed to receive neutralizing solution.

1. The (continuous) spray continuously removes particulate matter that collects on the plates 38 with no rapping losses.
2. The solution flowing down the surface of the plates 38 has a very low electrical resistivity and thus, removes any power restrictions that the high resistivity of dry fly ash might produce.
3. The alkaline solution reacts with the acid gases in the flue gas ($SO_2$, $SO_3$, HCl and HF) to partially remove these gases from the flue gas.

Tests sponsored by EPRI (Electric Power Research Institute) using water only have demonstrated that 95% of the particulate matter that enters the wet field is collected in that field (as opposed to the 50 to 70% for a conventional dry field) and that 20% of the $SO_2$ and 50% of the $SO_3$ are removed as well. If it is desirable to remove more than 20% of the acid gasses, then more than one of the electric fields can be converted to wet operation.

If an alkali solution is used, instead of water only, as described in the above paragraph, substantially more sulfur dioxide gases will be removed from the flue gas stream.

Clear Liquor Scrubbing Process (CLS)

The basic CLS concept is to recirculate clear liquor that contains a sufficient liquid-phase alkalinity to achieve the desired $SO_2$ removal efficiency without the need for solid-phase alkalinity. The liquor then flows to a limestone reactor and solid-liquid separator that precipitates a calcium-sulfur solid and returns clear liquor to the scrubber. The CLS process can be operated as an inhibited-oxidation system (calcium sulfite production) or as a forced-oxidation system (gypsum production). Either of these two products can then be converted to anhydrite; however, the economics of the anhydrite process are more favorable if calcium sulfite is produced in the CLS system.

To be successful, the CLS process must generate solids that are easily dewatered at high rates so that the high volume of liquor passing through the regeneration system does not require large or expensive tanks and equipment. Other key aspects for the success of the process include low consumption rates of the buffer, low L/G in the scrubber, and control of the chemistry to achieve good utilization and low scaling potential. The CLS process had been developed during prior EPRI testing using the 0.4-MW mini-pilot system at EPRI's Environmental Control Technology Center (ECTC).

Regarding the scrubbing solution of this invention, any number of solutions could be used, as are well known in the art. Exemplary solutions can be found in U.S. Pat. No. 5,486,342, the disclosure of which is herein incorporated by reference.

In the ESP of this invention, the amount of scrubbing solution being sprayed is on the order of or about 10 gallons/minute per mega-watt equivalent of flue gas. Described another way, the amount of solution is 2½ gallons of solution per minute per 1000 ACFM of gas treated by the device. It is to be understood that the amount of solution applied set forth can be varied and optimum amounts can be determined by workers skilled in the art.

Many advantages flow from the Electrostatic Precipitator of this invention.

The Electrostatic Precipitator will be easy to retrofit into existing equipment.

Pollutant particles will be efficiently removed from the flue gas.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An electrostatic precipitator comprising a housing having at one end a flue gas receiving port and at the other end of said housing a cleaned flue gas exhaust port defining a gas stream and between said flue gas receiving port and said cleaned flue gas exhaust port there are positioned within the housing a series of sets of electrostatic collector plates and wherein clear liquor neutralizing solution is sprayed on the last set of wet collector plates in the gas stream to cause pollutant particles and sulfur oxide gases to be removed from the flue gas and wherein the wet collector plates have about 35 kilovolt for a 9 inch gas passage and about 65 kilovolt for a 16 inch gas passage with the current being at least about fifty microamp per square foot of plate surface area, the dry plates being made of mild steel and the wet plates being smaller than dry plates and wherein the amount of clear liqueur neutralizing solution sprayed is about 10 gallon/minute of mega-watt of flue gas.

* * * * *